US008128366B2

(12) United States Patent
Strock et al.

(10) Patent No.: US 8,128,366 B2
(45) Date of Patent: Mar. 6, 2012

(54) COUNTER-VORTEX FILM COOLING HOLE DESIGN

(75) Inventors: Christopher W. Strock, Kennebunk, ME (US); Paul M. Lutjen, Kennebunkport, ME (US)

(73) Assignee: United Technologies Corporation, Hartford, CT (US)

( * ) Notice: Subject to any disclaimer, the term of this patent is extended or adjusted under 35 U.S.C. 154(b) by 943 days.

(21) Appl. No.: 12/157,117

(22) Filed: Jun. 6, 2008

(65) Prior Publication Data

US 2009/0304499 A1 Dec. 10, 2009

(51) Int. Cl.
*F01D 5/18* (2006.01)

(52) U.S. Cl. ..... 416/97 R

(58) Field of Classification Search ..... 416/95–96 A
See application file for complete search history.

(56) References Cited

U.S. PATENT DOCUMENTS

| | | | | |
|---|---|---|---|---|
| 2,489,683 | A | 11/1949 | Stalker | |
| 3,525,486 | A | 8/1970 | Wimpenny | |
| 4,529,358 | A * | 7/1985 | Papell | 416/97 A |
| 4,705,455 | A | 11/1987 | Sahm et al. | |
| 4,850,537 | A | 7/1989 | Gourdine | |
| 5,056,586 | A | 10/1991 | Bemisderfer | |
| 5,209,644 | A | 5/1993 | Dorman | |
| 5,413,463 | A | 5/1995 | Chiu et al. | |
| 5,456,596 | A | 10/1995 | Gourdine | |
| 5,704,763 | A | 1/1998 | Lee | |
| 6,092,982 | A | 7/2000 | Ikeda et al. | |
| 6,190,120 | B1 | 2/2001 | Thatcher et al. | |
| 6,254,347 | B1 | 7/2001 | Shaw et al. | |
| 6,416,283 | B1 * | 7/2002 | Johnson et al. | 416/97 R |
| 6,554,571 | B1 * | 4/2003 | Lee et al. | 416/92 |
| 6,722,134 | B2 | 4/2004 | Bunker | |
| 6,890,154 | B2 * | 5/2005 | Cunha | 416/97 R |
| 6,910,620 | B2 | 6/2005 | Hasz et al. | |
| 6,929,058 | B2 | 8/2005 | Liu et al. | |
| 6,997,675 | B2 | 2/2006 | Dube et al. | |
| 6,997,679 | B2 | 2/2006 | Beddard et al. | |
| 7,328,580 | B2 | 2/2008 | Lee et al. | |

(Continued)

FOREIGN PATENT DOCUMENTS

| | | |
|---|---|---|
| EP | 0 907 005 B1 | 3/2003 |
| GB | 2 202 907 A | 10/1988 |
| JP | 7-77006 | 3/1995 |

OTHER PUBLICATIONS

Dhungel et al., "Film Cooling From a Row of Holes Supplemented With Anti Vortex Holes," ASME Turbo Expo 2007: Power for Land, Sea and Air, May 2007, pp. 1-10.

*Primary Examiner* — Matthew W Such
(74) *Attorney, Agent, or Firm* — Kinney & Lange, P.A.

(57) ABSTRACT

An apparatus for use in a gas turbine engine includes a wall defining an exterior face, a first film cooling passage extending through the wall to a first outlet along the exterior surface of the wall for providing film cooling, and first and second rows of vortex-generating structures. The first film cooling passage defines a first interior surface region and a second interior surface region. The first row of vortex-generating structures is located along the first interior surface region, and the second row of vortex-generating structures is located along the second interior surface region. The first and second rows of vortex-generating structures are configured to inducing a pair of vortices in substantially opposite first and second rotational directions in a cooling fluid passing through the first cooling passage prior to reaching the first outlet.

16 Claims, 8 Drawing Sheets

U.S. PATENT DOCUMENTS

| | | | | |
|---|---|---|---|---|
| 7,762,775 | B1 * | 7/2010 | Liang | 416/97 R |
| 2003/0046934 | A1 | 3/2003 | Sherwood | |
| 2006/0260320 | A1 | 11/2006 | Bertolotti et al. | |
| 2007/0224048 | A1 * | 9/2007 | Abdel-Messeh et al. | 416/97 R |
| 2008/0031738 | A1 * | 2/2008 | Lee | 416/97 R |
| 2009/0087312 | A1 * | 4/2009 | Bunker et al. | 416/95 |

* cited by examiner

COUNTER-VORTEX FILM COOLING HOLE DESIGN

BACKGROUND

The present invention relates to film cooling, and more particularly to structures and methods for providing vortex film cooling flows along gas turbine engine components.

Gas turbine engines utilize hot fluid flows in order to generate thrust or other usable power. Modern gas turbine engines have increased working fluid temperatures in order to increase engine operating efficiency. However, such high temperature fluids pose a risk of damage to engine components, such as turbine blades and vanes. High melting point superalloys and specialized coatings (e.g., thermal barrier coatings) have been used to help avoid thermally induced damage to engine components, but operating temperatures in modern gas turbine engines can still exceed superalloy melting points and coatings can become damaged or otherwise fail over time.

Cooling fluids have also been used to protect engine components, often in conjunction with the use of high temperature alloys and specialized coatings. One method of using cooling fluids is called impingement cooling, which involves directing a relatively cool fluid (e.g., compressor bleed air) against a surface of a component exposed to high temperatures in order to absorb thermal energy into the cooling fluid that is then carried away from the component to cool it. Impingement cooling is typically implemented with internal cooling passages. However, impingement cooling alone may not be sufficient to maintain suitable component temperatures in operation. An alternative method of using cooling fluids is called film cooling, which involves providing a flow of relatively cool fluid from film cooling holes in order to create a thermally insulative barrier between a surface of a component and a relatively hot fluid flow. Problems with film cooling include flow separation or "liftoff", where the film cooling flow lifts off the surface of the component desired to be cooled, undesirably allowing hot fluids to reach the surface of the component. Film cooling fluid liftoff can necessitate additional, more closely-spaced film cooling holes to achieve a given level of cooling. Cooling flows of any type can present efficiency loss for an engine. The more fluid that is redirected within an engine for cooling purposes, the less efficient the engine tends to be in producing thrust or another usable power output. Therefore, fewer and smaller cooling holes with less dense cooling hole patterns are desirable.

The present invention provides an alternative method and apparatus for film cooling gas turbine engine components.

SUMMARY

An apparatus for use in a gas turbine engine includes a wall defining an exterior face, a first film cooling passage extending through the wall to a first outlet along the exterior surface of the wall for providing film cooling, and first and second rows of vortex-generating structures. The first film cooling passage defines a first interior surface region and a second interior surface region. The first row of vortex-generating structures is located along the first interior surface region, and the second row of vortex-generating structures is located along the second interior surface region. The first and second rows of vortex-generating structures are configured to inducing a pair of vortices in substantially opposite first and second rotational directions in a cooling fluid passing through the first cooling passage prior to reaching the first outlet.

DETAILED DESCRIPTION

The present invention, in general, relates to structures and methods for generating a counter-rotating vortex film cooling flow along a surface (or face) of a component for a gas turbine engine exposed to hot gases, such as a turbine blade, vane, shroud, duct wall, etc. Such a film cooling flow can provide a thermally insulative barrier between the gas turbine engine component and the hot gases. According to the present invention, vortex-generating structures positioned within a film cooling passage generate vortex flows rotating in substantially opposite directions (i.e., counter-rotating vortices) therein, prior to reaching an outlet at an exterior surface of the component that is exposed to the hot gases. In one embodiment of the present invention, the film cooling passage can have a slot-like shape and the vortex-generating structures can be rows of chevron-shaped ribs, with the chevron-shaped ribs of opposed rows facing in different directions. In another embodiment, the film cooling passage can be shaped like conjoined, parallel cylinders and the vortex-generating structures can be semi-helical ribs having a different orientation in each cylindrical portion of the film cooling passage. Additional features and benefits of the present invention will be recognized in light of the description that follows.

Figure 1:
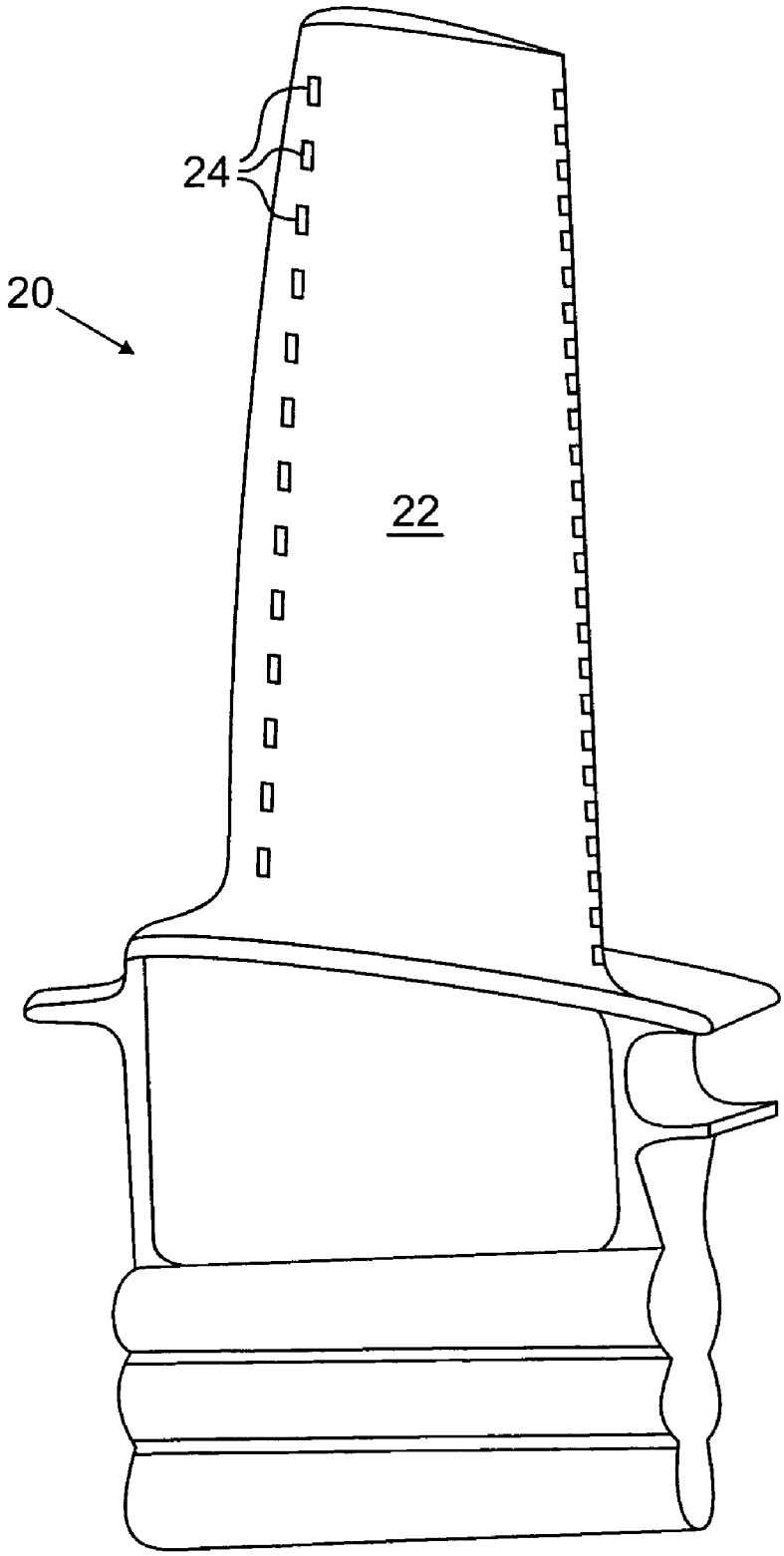
FIG. 1 is a perspective view of an exemplary film cooled turbine blade.

FIG. 1 is a perspective view of an exemplary film cooled turbine blade 20 having an airfoil portion 22. A plurality of film cooling hole outlets 24 are positioned along exterior sidewall surfaces of the airfoil portion 22 (only one side of the airfoil portion 22 is visible in FIG. 1). The hole outlets 24 are arranged in a spanwise row. During operation, the film cooling hole outlets 24 eject a film cooling fluid (e.g., compressor bleed air) to provide a thermally insulative barrier along portions of the turbine blade 20 exposed to hot gases. The particular arrangement of the film cooling hole outlets 24 shown in FIG. 1 is merely exemplary, and nearly any desired arrangement of the film cooling hole outlets 24 is possible in alternative embodiments. It should also be noted that the turbine blade 20 is shown merely as one example of a gas turbine engine component that can be film cooled according to the present invention. The present invention is equally applicable to other types of gas turbine engine components, such as vanes, shrouds, duct walls, etc.

Figure 2A:
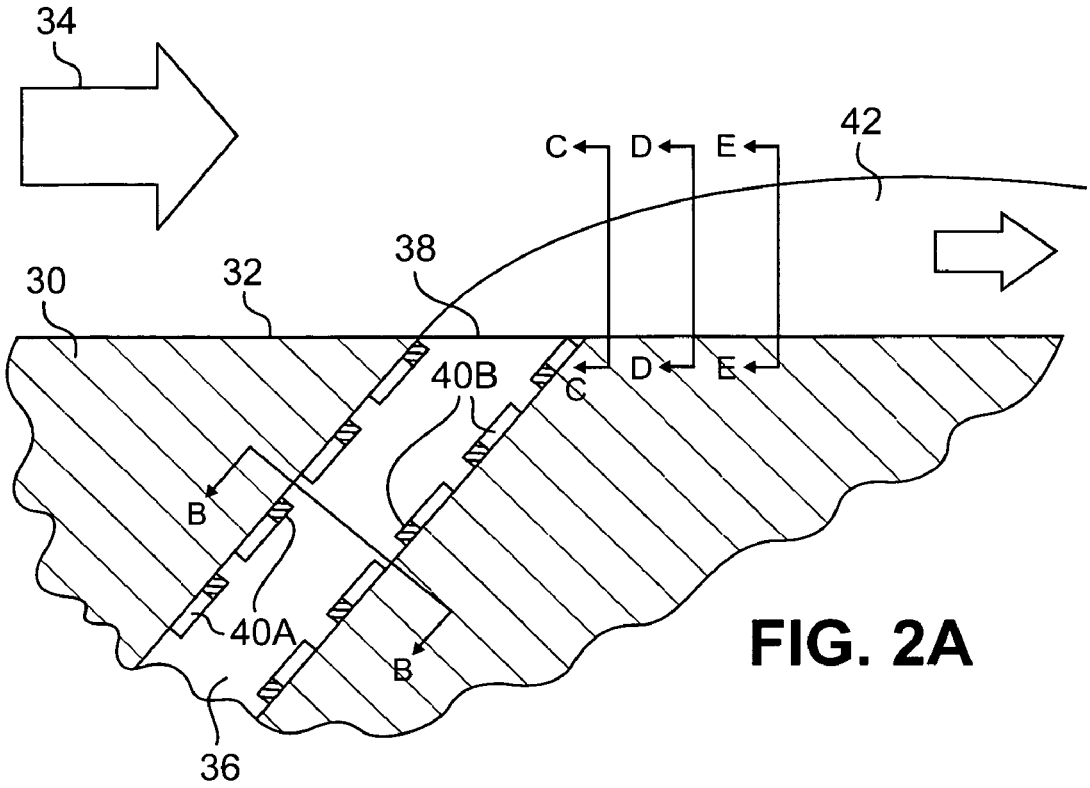
FIG. 2A is a cross-sectional view of a portion of a film cooled gas turbine engine component.

FIG. 2A is a cross-sectional view of a portion of a wall 30 of a film cooled gas turbine engine component. The wall 30 has an exterior surface 32 that is exposed to a hot gas flow 34. As shown in FIG. 2A, a substantially slot shaped first film cooling passage 36 extends through the wall 30 to a first outlet 38 located at the exterior surface 32 of the wall 30, the first film cooling passage 36 angled slightly toward a free stream direction of the hot gas flow 34. The first outlet 38 can be shaped similarly to a cross-sectional profile of an interior portion of the first film cooling passage 36, and can correspond to one of the plurality of film cooling hole outlets 24 shown in FIG. 1. As used herein, the term "slot shaped" refers to a relatively high aspect ratio, that is, a ratio of a longer dimension to a shorter dimension, and is not strictly limited to rectangular shapes. Slot shapes can include racetrack, elliptical, and other shapes with relatively high aspect ratios. A first row of substantially chevron-shaped vortex generating ribs 40A and a second row of substantially chevron-shaped vortex generating ribs 40B are positioned along an interior surface of the first film cooling passage 36. A film cooling fluid 42 passes through the first film cooling passage 36 and is ejected from the first outlet 38, and then forms a thermally insulative barrier along the exterior surface 32 of the wall 30 that extends downstream from the first outlet 38. Although only the first film cooling passage 36 is shown in FIG. 2A, additional film cooling passages with similar configurations can be located in the wall 30 (see FIG. 1), and all of the film cooling passages 36 can be connected to a common fluid supply manifold (not shown) or otherwise branched together.

Figure 2B:
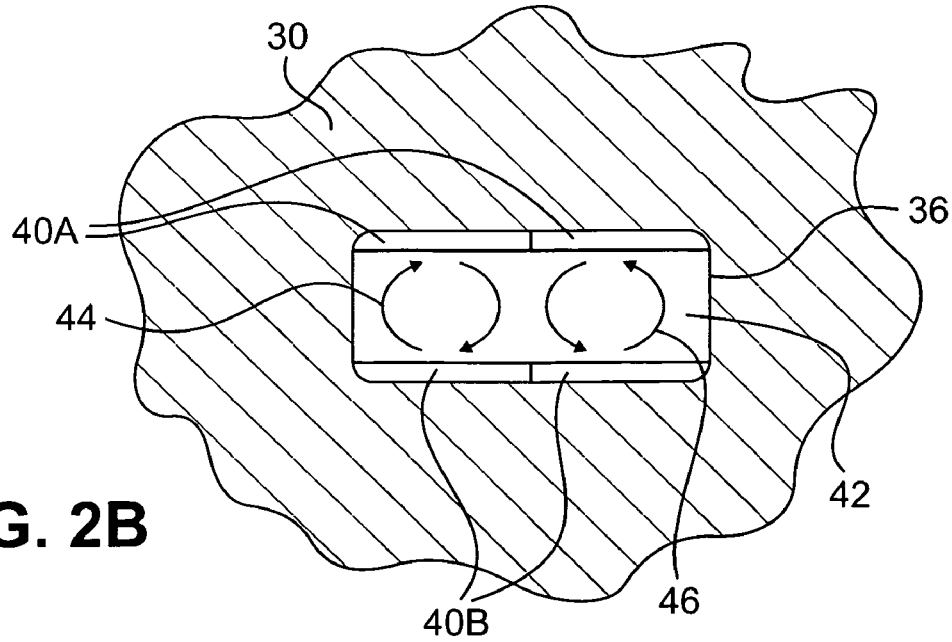
FIGS. 2B-2E are cross-sectional views of portions of the film cooled gas turbine engine component taken along lines B-B, C-C, D-D and E-E, respectively, of FIG. 2A.

FIG. 2B is a cross-sectional view of a portion of the wall 30 of the film cooled gas turbine engine component, taken along line B-B of FIG. 2A. The first film cooling passage 36 has a first and second rows of substantially chevron-shaped vortex-generating ribs 40A and 40B that generate a vortex flow in generally a first rotational direction 44 (e.g., clockwise) and a vortex flow in generally a second rotational direction 46 (e.g., counter-clockwise). The vortex-generating ribs 40A and 40B can be formed by investment casting along with the wall 30. The first and second rotational directions can be substantially opposite one another, such that the film cooling fluid 42 includes counter-rotating vortices defined by cooling fluid 42 rotating in the substantially opposite first and second rotational directions 44 and 46. In that regard, the vortex-generating structures can each induce flow in the cooling fluid 42 away from or toward a center of the first film cooling passage 36. It should be noted that the cross-section of FIG. 2B is taken at a location within the wall 30, upstream from the first outlet 38 of the film cooling passage 36 (see FIG. 2A), and counter-rotating vortex flows are present within the first film cooling passage 36 upstream from the first outlet 38.

Figure 2C:
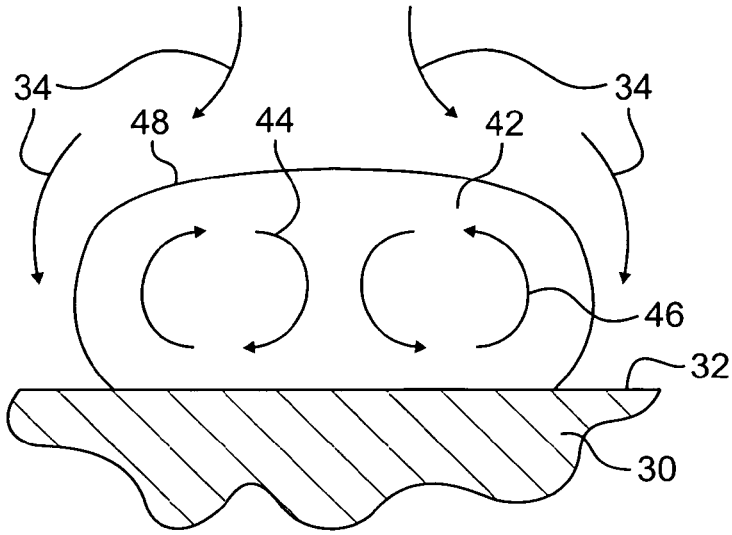

FIG. 2C is a cross-sectional view of a portion of the wall 30 of the film cooled gas turbine engine component, taken along line C-C of FIG. 2A just downstream from the first outlet 38 (not shown in FIG. 2C) along the exterior surface 32 of the wall 30 (relative to the hot gas flow 34). As shown in FIG. 2C, cooling fluid 42 from the first film cooling passage 36 (not shown in FIG. 2C) has formed a jet of the film cooling fluid 42 upon leaving the first outlet 38 (not shown in FIG. 2C). A boundary 48 is defined between the jet of the film cooling fluid 42 and the hot gas flow 34. The cooling fluid 42 passes along the exterior surface 32 of the wall 30, attached thereto, that is, the film cooling fluid 42 remains substantially in contact with the exterior surface 32 to form a barrier between the exterior surface 32 and the hot gas flow 34. The first and second rotational directions 44 and 46 can be arranged to generally oppose a tendency of the hot gas flow 34 to move toward the exterior surface 32 of the wall 30, thereby reducing "liftoff" or "flow separation" that occur when a portion of the hot gas flow 34 extends between the film cooling fluid 42 and the exterior surface 32 of the wall 30. In the illustrated embodiment, the first and second rotational directions 44 and 46 are arranged to flow generally toward the exterior surface 32 at a location where the vortexes adjoin each other, and generally away from the exterior surface 32 at lateral boundaries of the jet of the film cooling fluid 42.

Figure 2D:
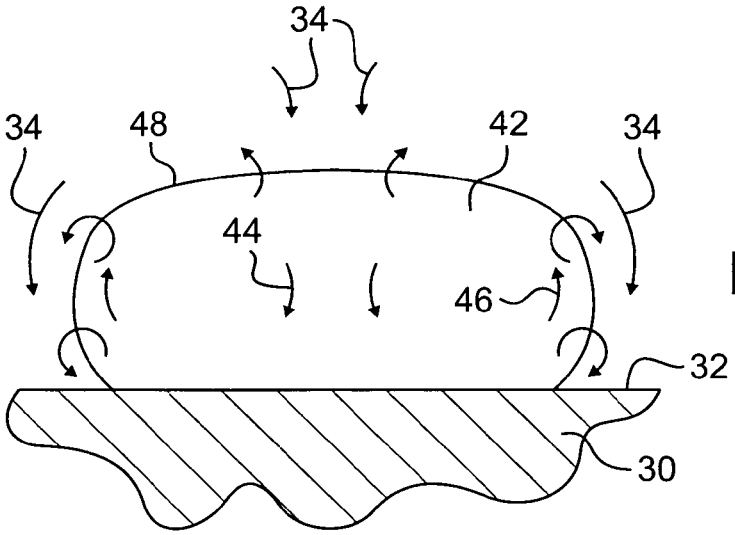

FIG. 2D is a cross-sectional view of a portion of the wall 30 of the film cooled gas turbine engine component, taken along line D-D of FIG. 2A downstream from the cross-sectional view shown in FIG. 2C (relative to the hot gas flow 34). As shown in FIG. 2D, the counter-rotating vortices defined by the film cooling fluid 42 rotating in the substantially opposite first and second rotational directions 44 and 46, respectively, causes mixing with the hot gas flow 34 at or near the boundary 48, which can reduce momentum of the counter-rotating vortices of the film cooling fluid 42 and also reduce or disrupt momentum of the hot gas flow 34 in a direction toward the wall 30. This mixing can help reduce "liftoff" of the film cooling fluid 42, such that the film cooling fluid 42 remains substantially attached to the exterior surface 32 of the wall.

Figure 2E:
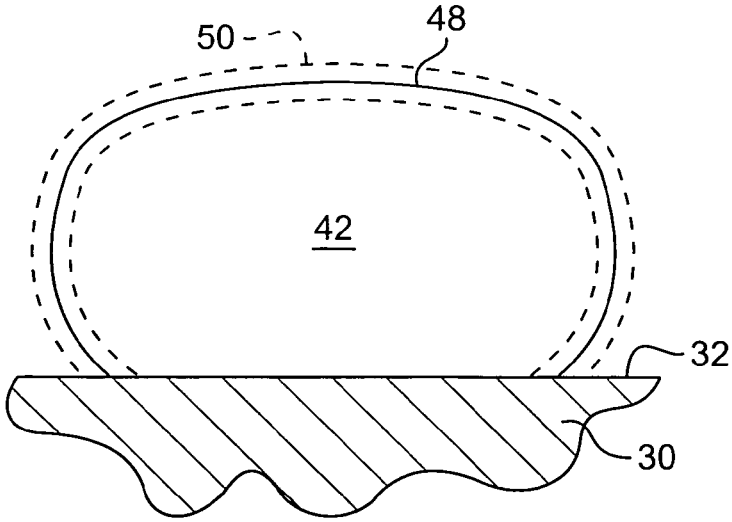

FIG. 2E is a cross-sectional view of a portion of the wall 30 of the film cooled gas turbine engine component, taken along line E-E of FIG. 2A downstream from the cross-sectional view of FIG. 2D. As shown in FIG. 2E, mixing of the film cooling fluid 42 with the hot gas flow 34 (not labeled in FIG. 2E) has formed a mixed fluid zone 48 around the original location of the boundary 48, which is no longer a distinct transition. The film cooling fluid 42 has lost essentially all rotational kinetic energy, meaning the counter-rotating vortices have substantially ceased to rotate. The film cooling fluid 42 still moves downstream along wall 30 substantially attached to the exterior surface 32. The film cooling fluid 42 will inevitably degrade as it continues downstream along the exterior surface 32 of the wall 30. However, the present invention can allow the film cooling fluid 42 to provide a relatively effective thermal barrier that is substantially attached to the exterior surface 32 for a relatively long distance along the wall 32 downstream from the first outlet 38.

Figure 3:
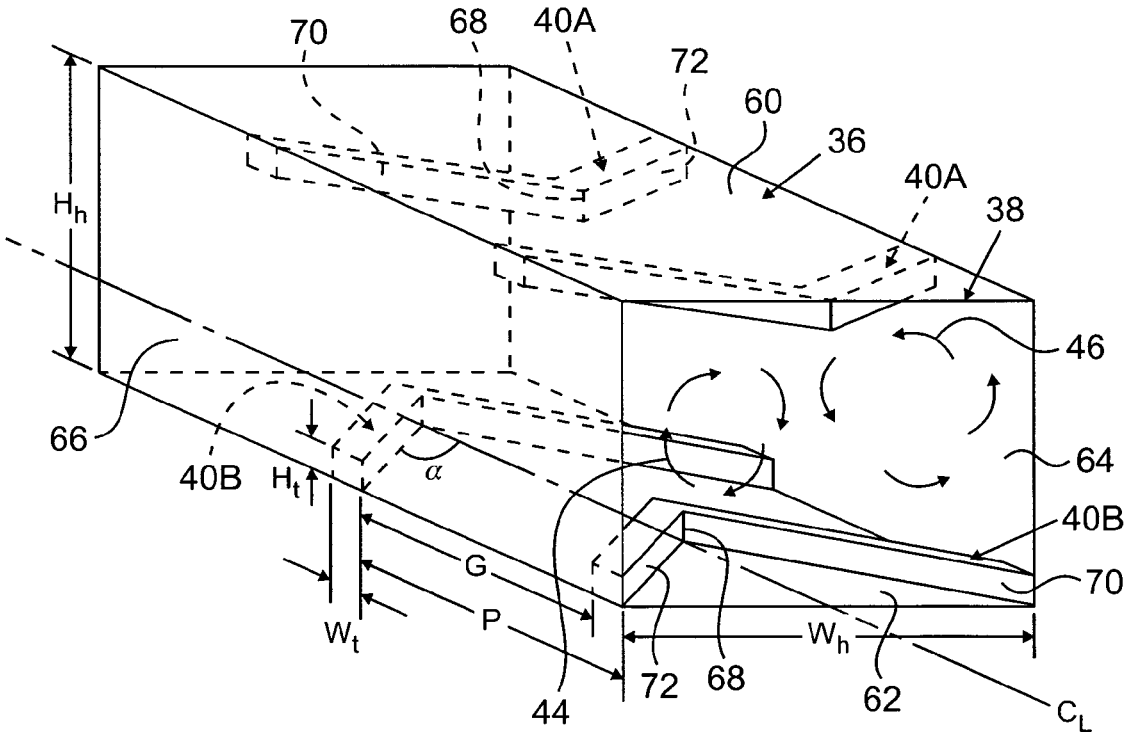
FIG. 3 is a perspective view of a film cooling passage, shown in isolation.

FIG. 3 is a perspective view of one embodiment of the first film cooling passage 36, shown in isolation. The first cooling passage 36 has an interior surface defined by first, second, third and fourth portions 60, 62, 64 and 66, respectively. In the illustrated embodiment, the first film cooling passage 36 has a substantially rectangular shape, with the first and second interior surface portions 60 and 62, respectively, being substantially planar and arranged opposite and substantially parallel to one another, and the third and fourth interior surface portions 64 and 66, respectively, being substantially planar and arranged opposite and substantially parallel to one another. The first row of vortex-generating structures 40A is positioned at the first interior surface portion 60, and the second row of vortex-generating structures 40B is positioned at the second interior surface portion 62. Although only two vortex-generating structures are shown in each row 40A and 40B, nearly any number of vortex-generating structures can be provided within each row. Individual vortex-generating structures of the first and second rows 40A and 40B need not be aligned relative to each other as shown in FIG. 3, but can be offset from each other along a length of the first film cooling passage 36.

As shown in FIG. 3, each chevron-shaped vortex generating structure of the first and second rows 40A and 40B includes an apex 68 and a pair of legs 70 and 72. The chevron-shaped vortex generating structure of the first and second rows 40A and 40B are arranged to face in opposite directions, that is, so that the apexes 68 face is opposite directions between the opposed first and second interior portions 60 and 62 of the first film cooling passage 36. The legs 70 and 72 of each chevron-shaped vortex generating structure of the first and second rows 40A and 40B can extend to contact the corresponding third and fourth interior portions 64 and 66 of the first film cooling passage 36. In alternative embodiments, a gap can be provided between the legs 70 and 72 and the third and fourth interior portions 64 and 66. Moreover, in further alternative embodiments, one or more of the chevron-shaped vortex generating structures of the first and second rows 40A and 40B can include legs 70 and 72 than do not join to form an apex, but rather have a gap therebetween.

The first film cooling passage 36 defines a height $H_h$ and a width $W_h$. The width $W_h$ of the first film cooling passage 36 can be oriented substantially perpendicular to a free stream direction of the hot gas flow 34. Each vortex generating structure of the first and second rows 40A and 40B defines a height $H_t$, a width $W_t$, and each of the legs 70 and 72 is positioned at an angle $\alpha$ with respect to a centerline $C_L$ of the passage 36. A pitch P is defined by the vortex generating structures located within each of the first and second rows 40A and 40B, and a gap G is defined between adjacent vortex generating structures located within each of the first and second rows 40A and 40B (where $G=P-W_t$). In some embodiment, the pitch P can be variable along a length of the first film cooling passage 36.

Figure 4A:
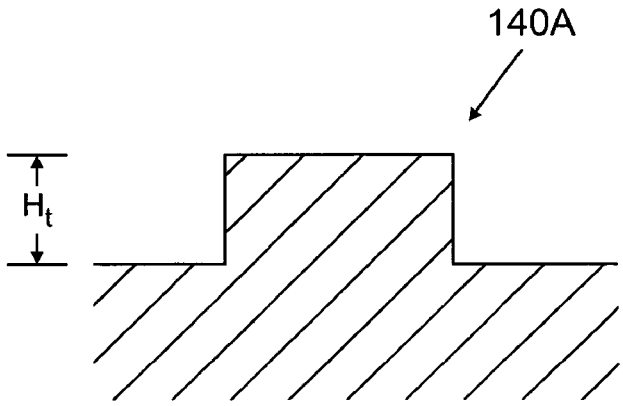
FIGS. 4A-4C are cross-sectional views of exemplary embodiments of vortex-generating structures.
Figure 4B:
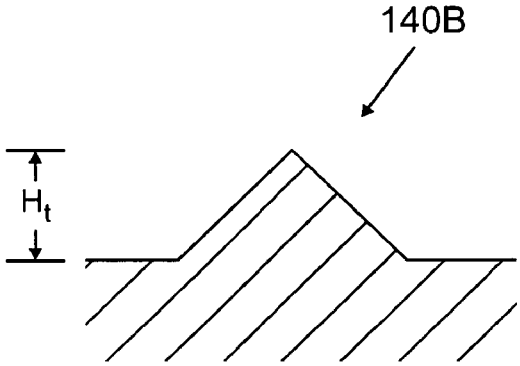
Figure 4C:
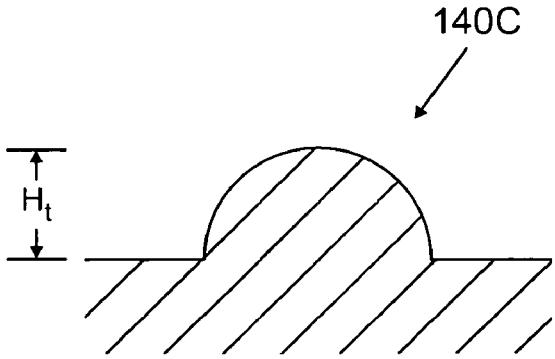

The vortex generating structure of the first and second rows 40A and 40B can have nearly any desired cross-sectional shape (or profile). FIGS. 4A-4C are cross-sectional views of exemplary embodiments of vortex-generating structures 140A-140C. The vortex-generating structure 140A shown in FIG. 4A has a substantially rectangular cross-sectional shape, the vortex-generating structure 140B shown in FIG. 4B has a substantially triangular cross-sectional shape, and the vortex-generating structure 140C shown in FIG. 4C has a substantially arcuate cross-sectional shape. It should be understood that further cross-sectional shapes can be utilized in alternative embodiments.

The following are descriptions of particular proportions for exemplary embodiments of the present invention. These embodiments are provided merely by way of example and not limitation. For example, a ratio of $H_t$ over $H_h$ can be within a range of approximately 0.05 to 0.4, or alternatively within a range of approximately 0.1 to 0.25. A ratio of $W_t$ over $H_t$ can be within a range of approximately 0.5 to 4, or alternatively within a range of approximately 0.5 to 1.5. A ratio of G over $H_t$ can be within a range of approximately 3 to 10, or alternatively within a range of approximately 4 to 6, and can be variable. A ratio of $W_h$ over $H_h$ can be within a range of approximately 1.5 to 8, or alternatively within a range of approximately 2 to 3. The angle $\alpha$ can be within a range of approximately 30° to 60°, or alternatively within a range of approximately 30° to 45°. Furthermore, a length of the first film cooling passage 36 can be at least approximately five to ten times a hydraulic diameter at the first outlet 38 (where the hydraulic diameter is defined as four times the cross-sectional area divided by the perimeter).

In alternative embodiments, vortex-generating structures can be placed on more or fewer interior surface portions of the first film cooling passage 36. For example, either the first or second row of vortex-generating structures 40A or 40B can be omitted in a further embodiment, and a ratio of $H_t$ over $H_h$ can be within a range of approximately 0.05 to 0.5, or alternatively within a range of approximately 0.1 to 0.3.

Figure 5:
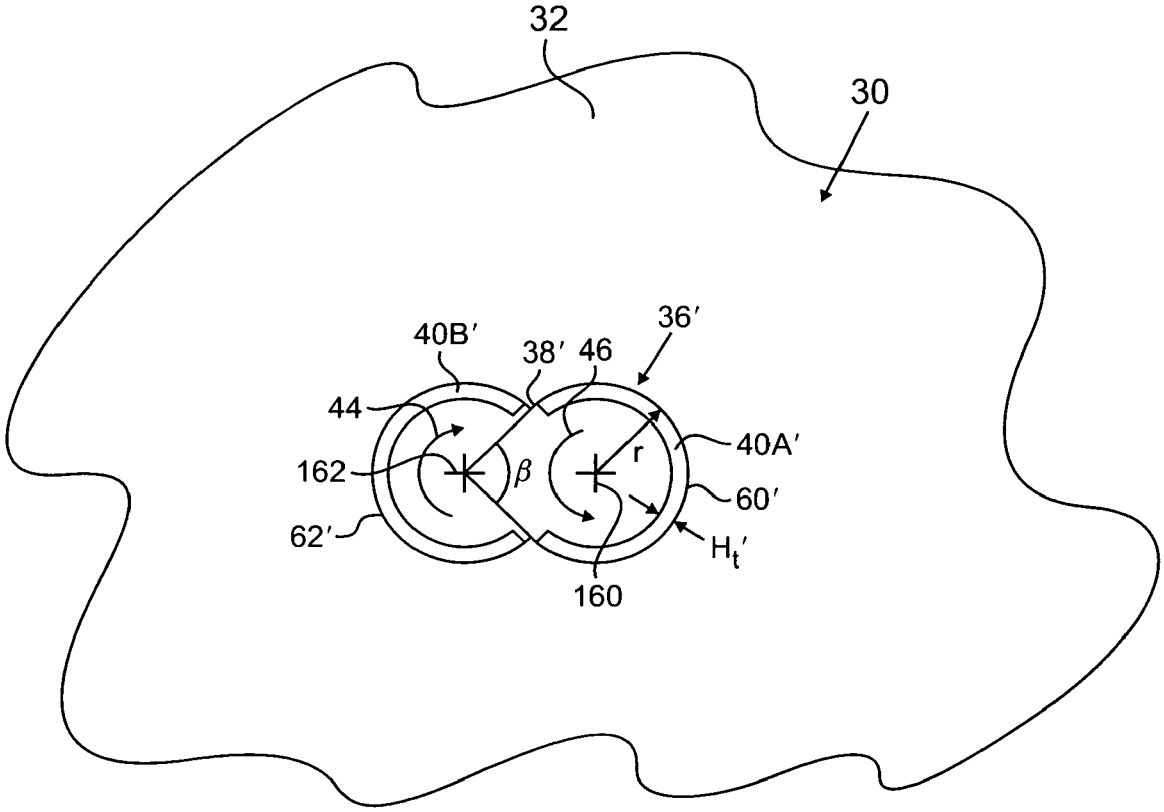
FIG. 5 is an elevation view of an alternative embodiment of the film cooling passage.

FIG. 5 is an elevation view of an alternative embodiment of the first film cooling passage 36'. In the illustrated embodiment, the passage 36' includes a first semi- or quasi-cylindrical portion defined by a first interior surface portion 60' about a first axis 160, and a second semi- or quasi-cylindrical portion defined by a first interior surface portion 62' about a second axis 162. The first and second axes 160 and 162 can be arranged substantially parallel to each other. The first and second semi-cylindrical portions each have a radius r, and are contiguous to define a common interior volume. The radius r of the first and second semi-cylindrical portions can be substantially equal. An opening where the first and second semi-cylindrical portion join can be defined by an angle $\beta$ measured from either the first or second axis 160 or 162 (angle $\beta$ is shown measured from the second axis 162 in FIG. 5). As used herein, the terms "semi-cylindrical" and "quasi-cylindrical" refer to partially cylindrical shapes, and not strictly shapes that are one half of a full cylinder, including, for example, elliptical, racetrack and other shapes as well.

A first vortex-generating structure 40A' is located along the first interior surface portion 60' and a second vortex-generating structure 40B' is located along the second interior surface portion 62'. A cross-sectional shape of the first and second vortex-generating structures 40A' and 40B' can have nearly any shape, such as those illustrated in FIGS. 4A-4C. By way of example, a ratio of a height $H_t'$ of the first and second vortex-generating structures 40A' and 40B' (measured in a similar fashion to the height $H_t$) over a diameter of either of the first and second semi-cylindrical portions of the film cooling passage 36' can be within a range between approximately 0.05 to 0.5, or alternatively within a range between approximately 0.1 to 0.3. The first and second vortex-generating structures 40A' and 40B' can each be semi-helical ribs, that is, discrete segments that each have shape forming at least part of a helix. The first and second vortex-generating structures 40A' and 40B' can be configured to twist in substantially opposite directions, or as mirror-images of each other, to generate a vortex flow in generally the first rotational direction 44 and a vortex flow in generally the second rotational direction 46. The counter-rotating vortex flow generated within the first film cooling passage 36' can then be ejected through a "figure eight" shaped outlet 38' to provide film cooling along the surface 32 of the wall 30. The counter-rotating vortex flow in a jet of film cooling fluid ejected from the first film cooling passage 36' functions similarly to that ejected from the other embodiment of the first film cooling passage 36 described above.

Figure 6:
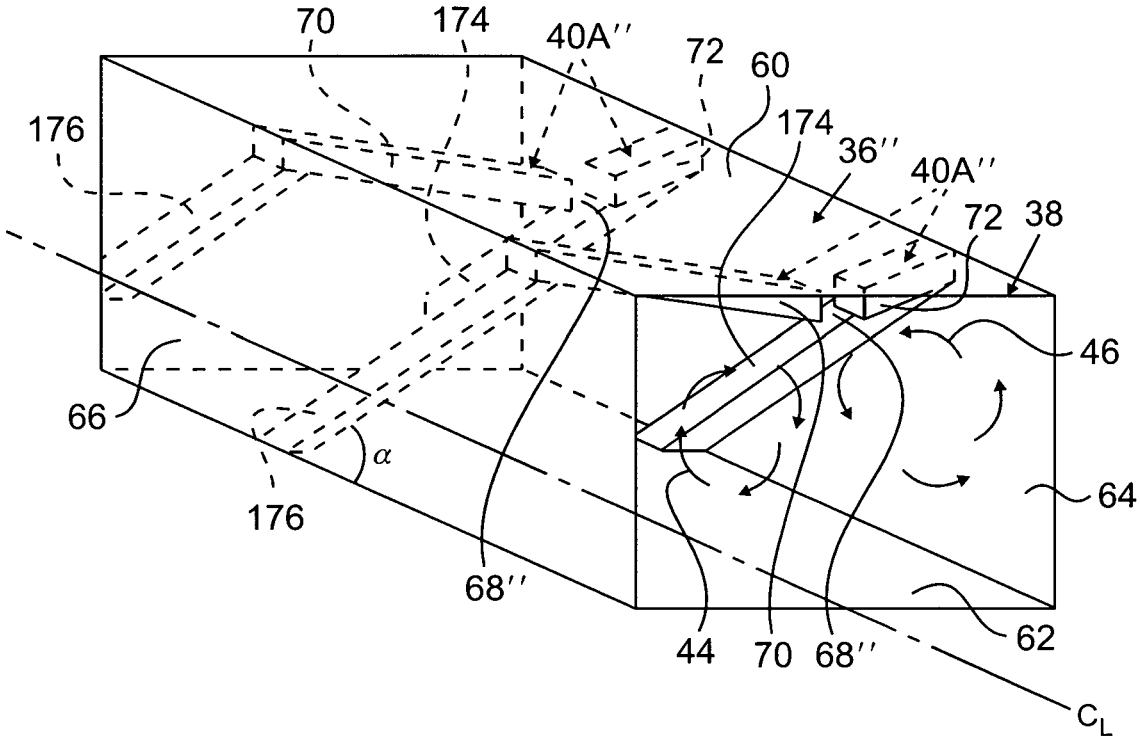
FIG. 6 is a perspective view of an alternative embodiment of a film cooling passage.

FIG. 6 is a perspective view of an alternative embodiment of a film cooling passage 36". In the illustrated embodiment, a first row of vortex-generating structures 40A" are located along the first interior surface 60 of the substantially slot-shaped film cooling passage 36". Each of the vortex generating structures in the row 40A" is formed by legs 70 and 72 that are spaced from each other at an apex gap 68", and positioned at the angle $\alpha$ with respect to the centerline $C_L$ (or a projection thereof). In other words, the legs 70 and 72 generally form a chevron shape, but a gap replaces the apex where the legs 70 and 72 would otherwise meet. Additionally, second and third rows of vortex-generating structures 174 and 176 can be formed along the third and fourth interior surfaces 64 and 66 of the film cooling passage 36", respectively. The second and third rows of vortex-generating structures 174 and 176 can be configured as angled ribs, as opposed to the chevron-like shapes on the first row of vortex-generating structures 40A", or can have different configurations as desired. Each of the vortex-generating structures of the second and third rows 174 and 176 can be positioned at approximately the angle $\alpha$. In the illustrated embodiment, the vortex-generating structures of the second and third rows 174 and 176 are angled to extend upstream within the passage 36" proximate the second interior surface 62. The each vortex-generating structures of the second row 174 can join a leg 72 of a corresponding one of the first row of vortex-generating structures 40A", and each vortex-generating structures of the third row 176 can join a leg 70 of a corresponding one of the first row of vortex-generating structures 40A". Vortex-generating structures 174 and 176 on the third and fourth interior surfaces 64 and 66 (i.e., the side walls) each generally only need to induce flow in one direction. In alternative embodiments, the second or third row of vortex-generating structures 174 and 176 can be omitted, and, furthermore, an additional row of vortex-generating structures can be added along the second interior surface 62 of the film cooling passage 36". Moreover, the particular shapes and configurations of the vortex-generating structures can vary as desired.

The present invention provides numerous advantages. For example, while the mixing of a film cooling fluid jet and hot gas flow represents an efficiency loss, that loss is balanced against improved film cooling effectiveness per film cooling passage. This can permit a given level of film cooling to be provided to a given component with a relatively small number of film cooling passages for a given film cooling fluid flow rate and/or increasing spacing between cooling hole passages and associated outlets. Moreover, even with relatively large cooling hole sizes, the present invention can provide film cooling to a given surface area with a relatively low density of cooling holes and a relatively low total cooling hole outlet area. Film cooling according to the present invention can help allow gas turbine engine components to operate in higher temperature environments with a relatively low risk of thermal damage.

Figure 7:
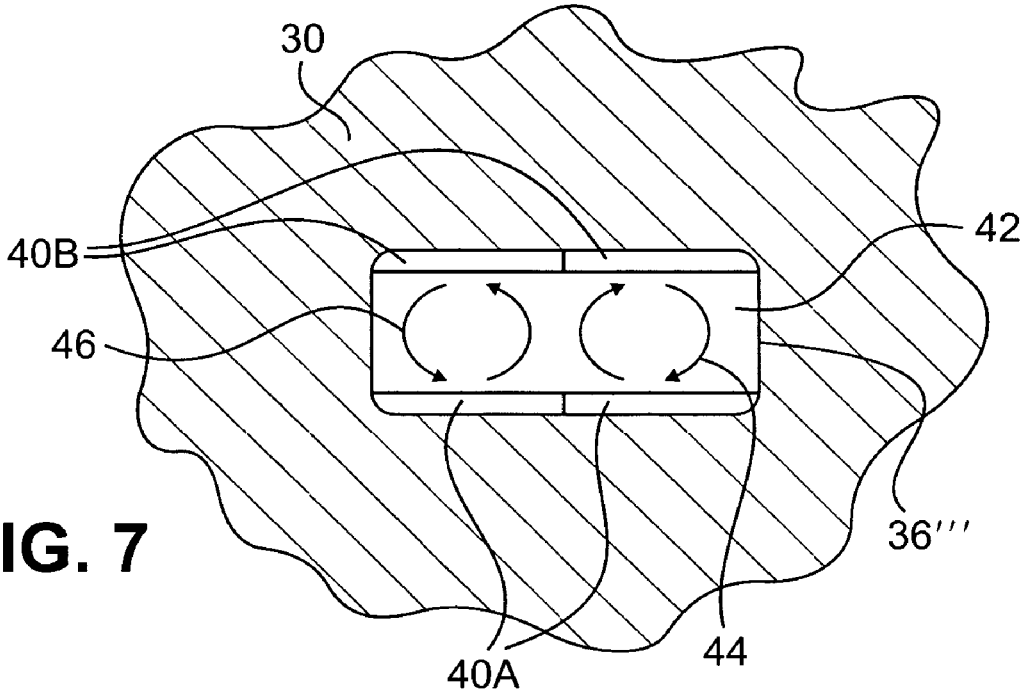
FIG. 7 is a cross-sectional view of a portion of another alternative embodiment of the film cooled gas turbine engine component.
Figure 8:
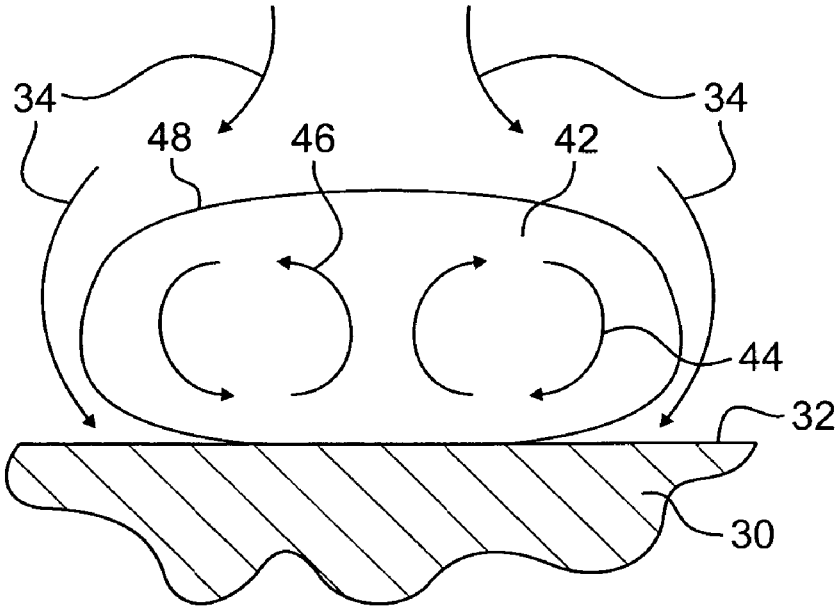
FIG. 8 is a cross-sectional view of a portion of the film cooled gas turbine engine component, taken downstream from the view of FIG. 7.

FIGS. 7 and 8 illustrate an alternative embodiment of the present invention, configured to produce a different effect from the previously described embodiments. FIG. 7 is a cross-sectional view of a portion of another alternative embodiment of the film cooled gas turbine engine component. As shown in FIG. 7, the vortex-generating structures 40A and 40B of a substantially slot-shaped film cooling passage 36'" have a configuration reversed (top-to-bottom) with respect to previously described embodiments. Substantially counter-rotating vortexes are created in the film cooling fluid 42 within the film cooling passage 36'" in the first rotational direction 44 (e.g., clockwise) and the second rotational direction 46 (e.g., counter-clockwise). FIG. 8 is a cross-sectional view of a portion of the wall 30 of the film cooled gas turbine engine component, taken downstream from the view of FIG. 7 (i.e., downstream from an outlet of the film cooling passage 36'"). As shown in FIG. 8, the first and second rotational directions 44 and 46 are arranged to flow generally away from the exterior surface 32 at a location where the vortexes adjoin each other, and generally toward the exterior surface 32 at lateral boundaries of the jet of the film cooling fluid 42. This configuration would essentially encourage liftoff of the fluid 42 from the exterior surface 32 (i.e., the entrainment of the hot gas flow 34 between the exterior surface 32 and the cooling fluid 42), which may be desirable for fluidic injection applications, etc.

Although the present invention has been described with reference to preferred embodiments, workers skilled in the art will recognize that changes may be made in form and detail without departing from the spirit and scope of the invention. For instance, the particular angle film cooling passages relative to a film cooled surface can vary as desired for particular applications. Moreover, a cross-sectional area of film cooling passages of the present invention can vary over their length (e.g., with tapering or substantially conical film cooling passages).

The invention claimed is:

1. An apparatus for use in a gas turbine engine, the apparatus comprising:

a wall defining an exterior face;

a first film cooling passage extending through the wall to a first outlet along the exterior surface of the wall for providing film cooling, wherein the first film cooling passage defines a first interior surface region and a second interior surface region;

a first row of vortex-generating structures located along the first interior surface region of the first film cooling passage, wherein the first row of vortex-generating structures comprises a first row of chevron-shaped ribs each having an apex; and a second row of vortex-generating structures located along the second interior surface region of the first film cooling passage, wherein the second row of vortex-generating structures comprises a second row of chevron-shaped ribs each having an apex, and wherein the apexes of the chevron-shaped vortex-generating ribs of the first and second rows face in opposite directions, and wherein the first and second rows of vortex-generating structures are configured to induce a pair of vortices in substantially opposite first and second rotational directions in a cooling fluid passing through the first cooling passage prior to reaching the first outlet.

2. The apparatus of claim 1, wherein the first film cooling passage is substantially slot shaped.

3. The apparatus of claim 1, wherein the first film cooling passage has a substantially rectangular shape in cross-section.

4. The apparatus of claim 1, wherein the first outlet is substantially slot shaped.

5. The apparatus of claim 1, wherein the first interior surface region and the second interior surface region are arranged opposite one other.

6. The apparatus of claim 1, wherein the first and second rotational directions are arranged to flow generally toward the exterior face of the wall at a location where the vortexes adjoin each other.

7. The apparatus of claim 1, wherein the wall comprises a sidewall of a turbine blade.

8. The apparatus of claim 1, wherein the first interior surface region and the second interior surface region are arranged immediately adjacent one another.

9. The apparatus of claim 1, the first film cooling passage further comprising third and fourth interior surface regions, wherein at least one structure of the first row of vortex-generating structures contacts both the third and fourth interior surface regions.

10. The apparatus of claim 1 and further comprising:

a second film cooling passage extending through the wall to a second outlet along the exterior surface of the wall for providing film cooling, wherein the second film cooling passage defines a first interior surface region and a second interior surface region, and wherein the second outlet is spaced from the first outlet along the wall;

a first row of vortex-generating structures located along the first interior surface region of the second film cooling passage; and a second row of vortex-generating structures located along the second interior surface region of the second film cooling passage, wherein the first and second rows of vortex-generating structures are configured to inducing a pair of vortices in substantially opposite first and second rotational directions in a cooling fluid passing through the second cooling passage prior to reaching the second outlet.

11. An apparatus for use in a gas turbine engine, the apparatus comprising:

a wall defining an exterior face;

a film cooling passage extending through the wall to an outlet located along the exterior surface of the wall for providing film cooling;

a first row of vortex-generating structures located along the film cooling passage upstream from the outlet, wherein the first row of vortex-generating structures comprises a first row of chevron-shaped ribs each having an apex; and a second row of vortex-generating structures located along the film cooling passage, wherein the second row of vortex-generating structures comprises a second row of chevron-shaped ribs each having an apex, and wherein the apexes of the chevron-shaped vortex-generating ribs of the first and second rows face in opposite directions, and wherein the first and second rows of vortex-generating structures are configured to induce a pair of vortices in substantially opposite first and second rotational directions in a cooling fluid passing through the film cooling passage prior to reaching the outlet.

12. The apparatus of claim 11, wherein the first and second rows of vortex generating structures are arranged at first and second interior surface regions, respectively, located opposite one another along an interior of the film cooling passage.

13. The apparatus of claim 11, wherein the film cooling passage is substantially slot shaped, and wherein the outlet is substantially slot shaped.

14. The apparatus of claim 11, wherein the first and second rotational directions are substantially opposite one another.

15. Previously Presented) A method of film cooling a gas turbine engine component exposed to a hot fluid stream, the method comprising:

directing a cooling fluid into a first film cooling passage of the component;

passing the cooling fluid over at least one first chevron-shaped vortex-generating structure to rotate a portion of the cooling fluid within the first film cooling passage in a first rotational direction;

passing the cooling fluid over at least one second chevron-shaped vortex-generating structure to rotate a portion of the cooling fluid within the first film cooling passage in a second rotational direction that counter-rotates with respect to the first rotational direction;

ejecting the cooling fluid counter-rotating in both the first and second rotational directions out of a first outlet in fluid communication with the first film cooling passage; and passing the counter-rotating cooling fluid ejected from the first outlet along an exterior surface of the component to provide film cooling therealong.

16. The method of claim 15, wherein the counter-rotation of the cooling fluid offsets rotational momentum in the hot fluid stream to reduce cooling flow separation relative to the exterior surface of the component.

* * * * *